US011598596B2

(12) United States Patent
Parker et al.

(10) Patent No.: US 11,598,596 B2
(45) Date of Patent: Mar. 7, 2023

(54) FIREARM FOR USE WITH ORDNANCE OF VARYING LENGTHS

(71) Applicant: O.F. MOSSBERG & SONS, INC., North Haven, CT (US)

(72) Inventors: Derek Parker, Wallingford, CT (US); Thaddeus Boruchowski, Eagle Pass, TX (US); David Johnson, Hamden, CT (US); Wayne Hopkins, Wallingford, CT (US)

(73) Assignee: O.F. MOSSBERG & SONS, INC., North Haven, CT (US)

( * ) Notice: Subject to any disclaimer, the term of this patent is extended or adjusted under 35 U.S.C. 154(b) by 0 days.

(21) Appl. No.: 17/161,312

(22) Filed: Jan. 28, 2021

(65) Prior Publication Data

US 2021/0254913 A1 Aug. 19, 2021

Related U.S. Application Data

(60) Provisional application No. 62/966,874, filed on Jan. 28, 2020.

(51) Int. Cl.
*F41A 9/37* (2006.01)
*F41A 9/46* (2006.01)
(Continued)

(52) U.S. Cl.
CPC ..... *F41A 9/37* (2013.01); *F41A 9/42* (2013.01); *F41A 9/46* (2013.01); *F41C 7/02* (2013.01)

(58) Field of Classification Search
CPC ..... F41A 9/37; F41A 9/42; F41A 9/46; F41A 9/58
See application file for complete search history.

(56) References Cited

U.S. PATENT DOCUMENTS 2,480,017 A * 8/1949 Green ..... F41A 3/32 42/21
2,589,250 A * 3/1952 Heenan ..... F41A 9/58 89/33.2

(Continued)

FOREIGN PATENT DOCUMENTS

WO 2014031590 A1 2/2014
WO 2021225647 A2 11/2021

OTHER PUBLICATIONS

Dan Zimmerman, Gear Review: OPSol Mini-Clip for Mossberg Shotguns, Jul. 4, 2017, internet publication, pp. 1-8 of 15, found here: https://www.thetruthaboutguns.com/gear-review-opsol-mini-clip-mossberg-shotguns/ (Year: 2017).*

(Continued)

*Primary Examiner* — Bret Hayes
(74) *Attorney, Agent, or Firm* — Kutak Rock LLP; Bryan P. Stanley

(57) ABSTRACT

A firearm system is provided. A pump-action firearm, such as a shotgun, includes a buffer attached to a trigger housing. The buffer consists of a resilient or semi-resilient material and is positioned such as to face towards an opening the receiver in which the magazine tube is partially received. The buffer includes a contoured bottom surface and an upper surface, configured in a way which shortens the space available within an opening of a receiver while accommodating the loading of shells into a magazine tube. Upon moving a shell into the opening, such as by pumping the action, the shell impacts the buffer, which stabilizes the shell prior to being lifted by an elevators. For shorter shells, this reduces the risk of a jamming event. For longer shells, the buffer is configured to compress to accommodate the additional length.

19 Claims, 14 Drawing Sheets

(51) Int. Cl.
*F41A 9/42* (2006.01)
*F41C 7/02* (2006.01)

(56) References Cited

U.S. PATENT DOCUMENTS 2,840,944 A * 7/1958 Thompson ..... F41A 9/71 42/50
3,054,206 A * 9/1962 Raleigh ..... F41A 9/58 42/18
3,990,169 A * 11/1976 Jennie ..... F41A 9/58 42/106
4,242,825 A * 1/1981 deBoer ..... F41A 9/58 42/106
5,870,846 A 2/1999 Ledford
10,309,736 B2 6/2019 Warburton et al.
D857,832 S * 8/2019 Henry ..... F41A 9/71 D22/108
2005/0066800 A1* 3/2005 Hagan ..... F41A 9/58 89/1.806
2020/0158469 A1* 5/2020 Balgaard ..... F41G 1/02

OTHER PUBLICATIONS

Author unknown, Mossberg Owners Manual for 500 series shotguns, Oct. 23, 2015, Mossberg (presumably), all pages. (Year: 2015).*
"International Search Report and Written Opinion for International Application No. PCT/US2021/015535, Search completed on Nov. 4, 2021, dated Nov. 8, 2021.".
"Zimmerman, Dan. Gear Review: OPSol Mini-Clip for Mossberg Shotguns. the truth about guns [online], Jul. 4, 2017 [retrieved on Oct. 22, 2021]. Retrieved from <URL: https://www.thetruthaboutguns.com/gear-review-opsol-mini-clip-mossberg-shotguns/>. pp. 1-6".
Smith & Wesson; https://www.smith-wesson.com/product/mp-12?sku=12490; last accessed on Dec. 2, 2021.
"International Preliminary Report on Patentability for International Application PCT/US2021/015535, Report issued Jul. 28, 2022, dated Aug. 11, 2022".

* cited by examiner

FIREARM FOR USE WITH ORDNANCE OF VARYING LENGTHS

CROSS-REFERENCE TO RELATED APPLICATIONS

This application claims priority pursuant to 35 U.S.C. 119(e) to U.S. Provisional Patent Application Ser. No. 62/966,874, filed Jan. 28, 2020, the entire disclosure of which is incorporated herein by reference.

FIELD OF THE INVENTION

The present invention relates generally to firearms. More specifically, the present invention is concerned with shotguns, or other firearms, configured for use with ordnance of varying lengths while minimizing the risk of jamming associated with shorter shells.

BACKGROUND

Many repeating firearms, such as shotguns, utilize tubular magazines that extend parallel to and below the barrel for holding rounds of ammunition. In the case of a conventional shotgun, the tube magazine has an opening into the receiver of the shotgun through which shotshells pass when the shotgun action is cycled. In a pump action shotgun, a user may cycle the action by pulling the forend rearward which results in a cartridge stop being disengaged. This allows a shotshell to be expelled by a spring-loaded follower and into the receiver below the level of the barrel. A shell elevator prevents the shotshell from falling out of a loading port of the receiver located in the bottom surface thereof. When the forend is then pushed forward, the elevator is raised to bring the front of the shotshell in position to be fed to the chamber at the rear of the barrel. The bolt moves forward and pushes the shell into the chamber and one or more extractors may engage a rim on the shotshell casehead.

Standard 12 gauge shotgun shells have long been available in 2⅝ inch loadings and magnum loadings have been available in 3 and 3½ inch loadings. Various pump action and autoloading shotguns have been designed to be compatible with shotshell lengths from 2¾ to 3½ inches. However, even standard shotgun loadings can produce stout recoil which can be off-putting to some shooters. Also, as shotshells are arranged end-to-end in conventional tube magazines, the length of the shotshells determines the number that will fit in a tube of a given length. This means longer shells translate to lower magazine capacity.

To provide shotshells generating lower recoil and/or to increase magazine capacity, ammunition manufactures have begun to offer shotshell loadings in a 1¾ inch length. These are marketed by FEDERAL under the trademark SHORTY SHOTSHELLS and by AGUILA under the trademark MINI-SHELL. These shells allow for greater magazine capacity without modifying the firearm, and also may utilize less propellant which translates to a lower recoil perceived by the shooter. Unfortunately, the benefits of these shorter shells are difficult to take advantage of due to decreased reliability in repeating shotguns.

When used in conventional repeating shotguns, 1¾ inch shells tend to increase the occurrence of various malfunctions. When the action is open and the shell has been expelled into the receiver, there is a volume of empty space that the shell can occupy. Larger shells occupy more space and thus have less freedom of movement. However, short shells can rotate to a much larger degree such that they become misaligned with the barrel chamber. Additionally, this freedom of movement can allow the short shells to rotate so much that they effectively act as a wedge between the top of the receiver and the elevator, thus jamming the action. Since they are expelled from the magazine tube under spring pressure, the shells may be moving with significant velocity and bounce of the breach face of the bolt or trigger housing. Because this occurs at an oblique angle, the shell experiences a torque and will tend to rotate leading to a malfunction.

It is possible to modify a repeating shotgun design to make it compatible with a newly introduced length of cartridge. For example, after the introduction of 3½ inch shotshells, some existing repeating shotguns were modified to have longer receivers that can accept and cycle these longer shotshells. However, using a longer receiver increases the internal volume in which the shotshells can rotate. In order to modify such designs to function more reliably with 1¾ inch shotshells, such receivers would need to be shortened such that they cannot function with 3 inch shells. This would limit the versatility of these firearms.

Accordingly, there is a need for a shotgun/firearm configured to reliably cycle shells of any length from 1¾ to 3 inches.

SUMMARY

The present invention comprises a modified firearm, such as a shotgun, which accommodates ordnances (including, but not necessarily limited to shotshells) of variable length. In some embodiments, a repeating, pump-action shotgun/firearm design is modified to function reliably with shotshells ranging in length from 1¾ to 3 inches. A shell elevator is disposed within a receiver, functioning to elevate a shell from a magazine tube and elevate it towards a barrel.

A shell exiting the magazine tube passes into an opening associated with the receiver. This opening is typically sized for shotshells of a certain length. However, the working mechanisms enable utilizing shotshells of variable lengths. To reduce the risk of jamming, a buffer is included. The buffer is positioned extending forward of a front face of a housing below the course of travel of a bolt slide when the action of the shotgun is cycled. In various embodiments, the buffer attaches to the housing, or otherwise to the walls of the receiver, and in some embodiments is removable, such that one or more buffer may be configured to be interchangeable within the same firearm. One of more face of the buffer includes a curved, chined or faceted face. When the action of the firearm is cycled a shotshell is dispensed from the magazine tube and into the receiver. The shotshell travels rearward until it impacts the buffer along a front face of the buffer. The buffer is configured such that the impact occurs proximate to the mid area of the shell base to reduce torque experienced by the shotshell, and thus reduce the likelihood that the shotshell tips or rotates out of proper orientation and resulting in a jam of the firearm.

The buffer is made of a resilient material, such as a polymer including an elastomer, rubber, foam rubber, or other suitable material. The material of the buffer is selected to receive the impact of a shotshell as it is expelled from the magazine tube and act as a shock absorber, allowing buffer to dampen forces associated with the expelled shotshell. Advantageously, this reduces the ability for the shotshell to rotate or otherwise contribute to a jamming event. The surface of the buffer that interacts with the shotshell also functions to redirect the momentum of the shotshell as it enters the receiver, reducing the likelihood of improper rotation or tipping of the shotshell. The buffer also occupies a portion of the volume within the receiver that would be available for the shotshell to move within the receiver, further reducing the freedom of movement of shotshell and reducing the opportunity for a jamming event.

As the buffer is interchangeable, it includes several features which ensure proper installation. A dovetail groove in the face of the housing receives a dovetail projection of the buffer. This ensures that the buffer resists rotational and translational forces at least along one axis during operation. The buffer also includes a tab feature. This tab feature is positioned relative the dovetail and stops the buffer from being over-inserted by physically contacting the housing during installation, helping ensure proper functioning of the buffer.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Specifically, although the embodiments shown and described herein are those of shotguns or other firearms utilizing shotshell style ammunition of certain length, it will be appreciated that other embodiments utilize other types of ammunition as well as other varying lengths of ammunition, now known or hereafter developed. Furthermore, it will be appreciated that other embodiments will utilize other types of action and magazine structures in addition to those described herein, as well as various other structures of all other typical component of a firearm (e.g. receiver, bolt, barrel, trigger assembly, etc.).

Figure 1:
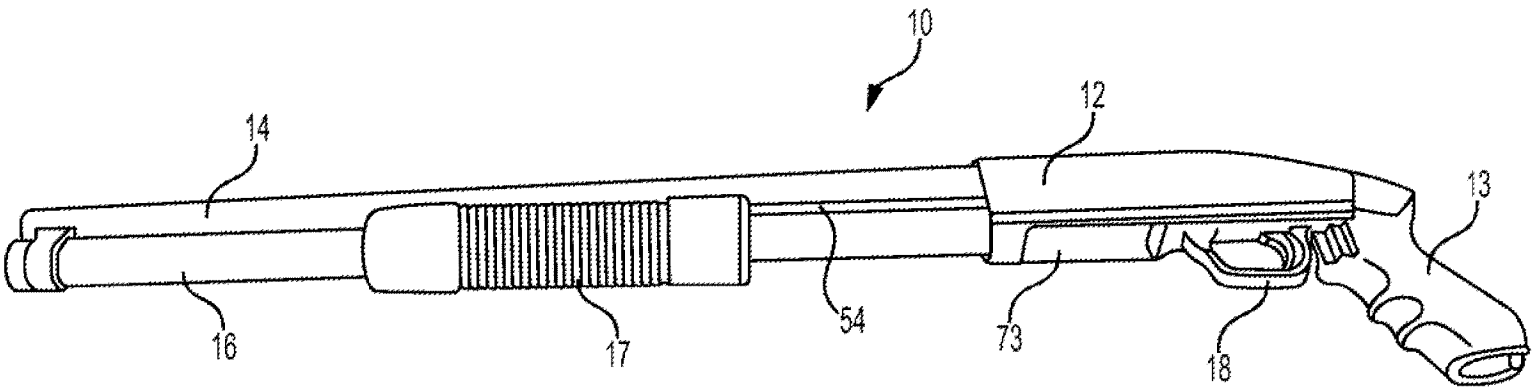
FIG. 1 is a perspective view of a firearm according to some embodiments of the present invention.
Figure 2:
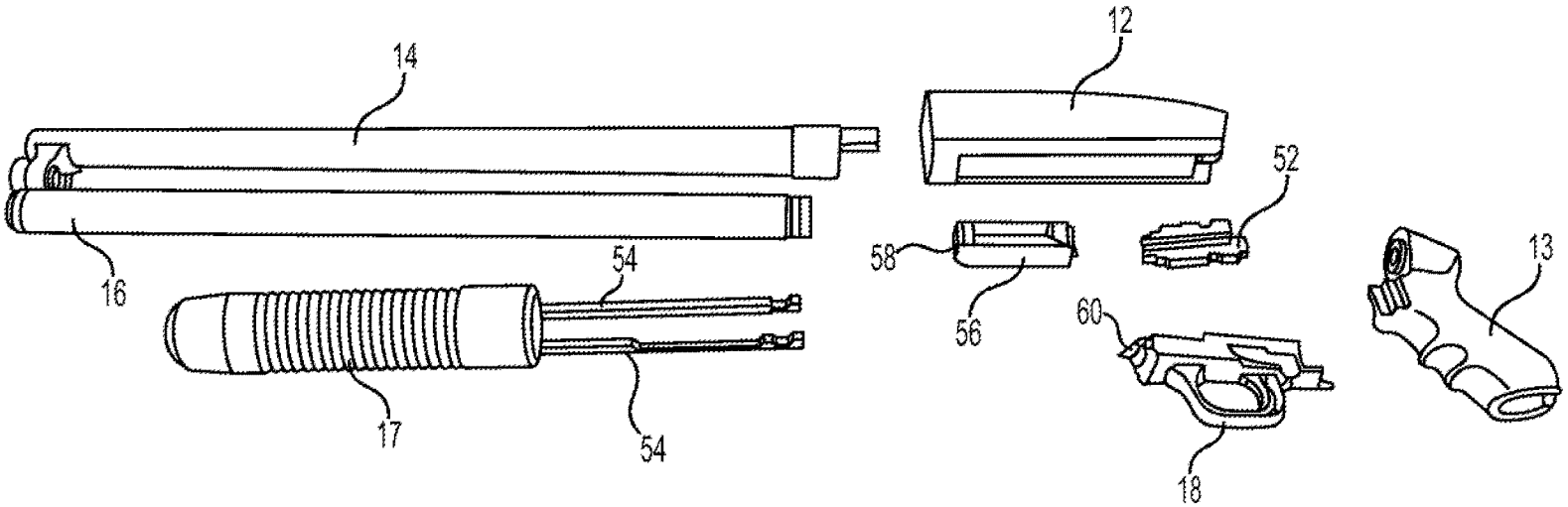
FIG. 2 is an exploded perspective view of the firearm of FIG. 1.
Figure 3:
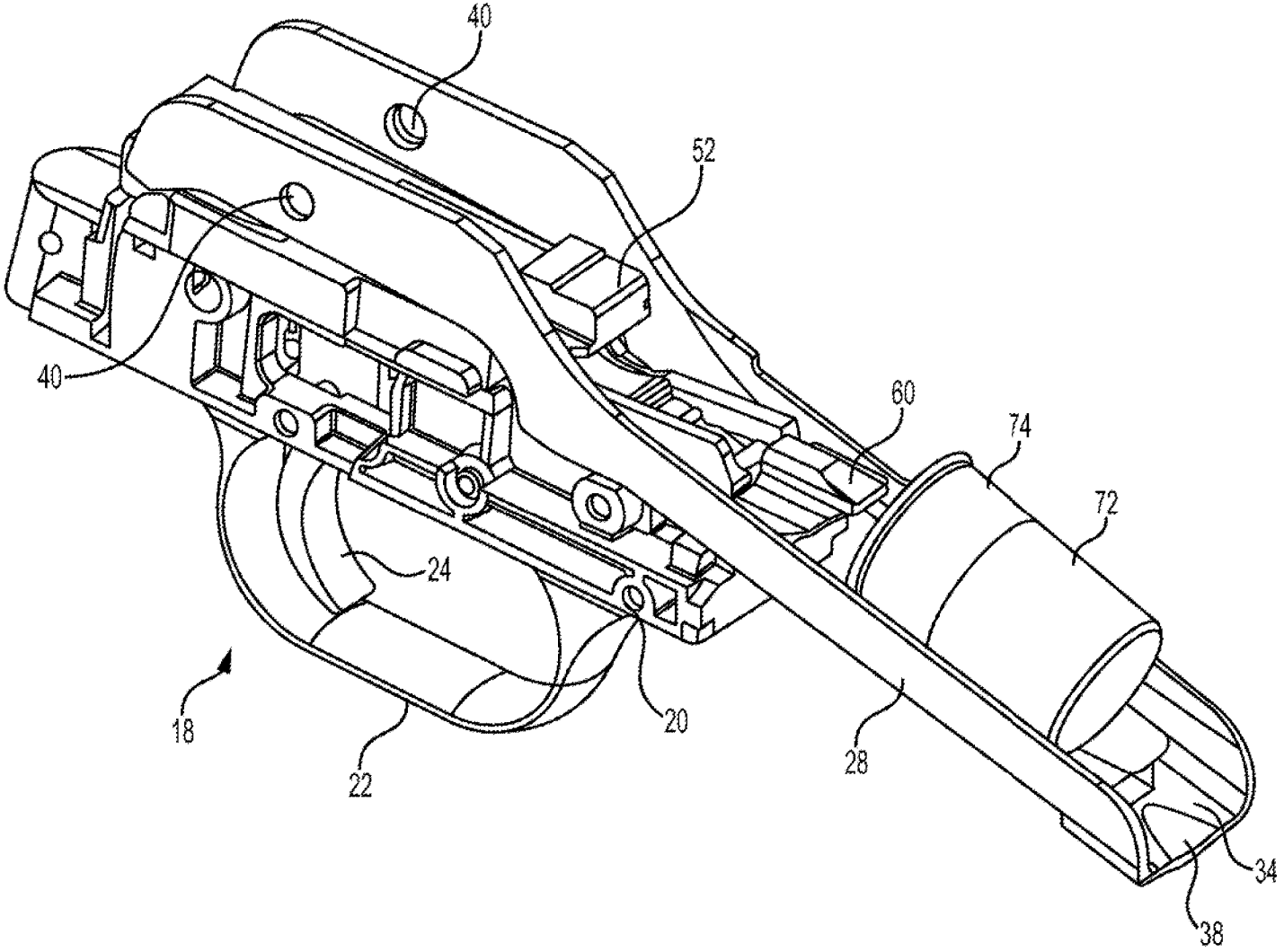
FIG. 3 is a perspective view of a trigger assembly according to some embodiments of the present invention.
Figure 4:
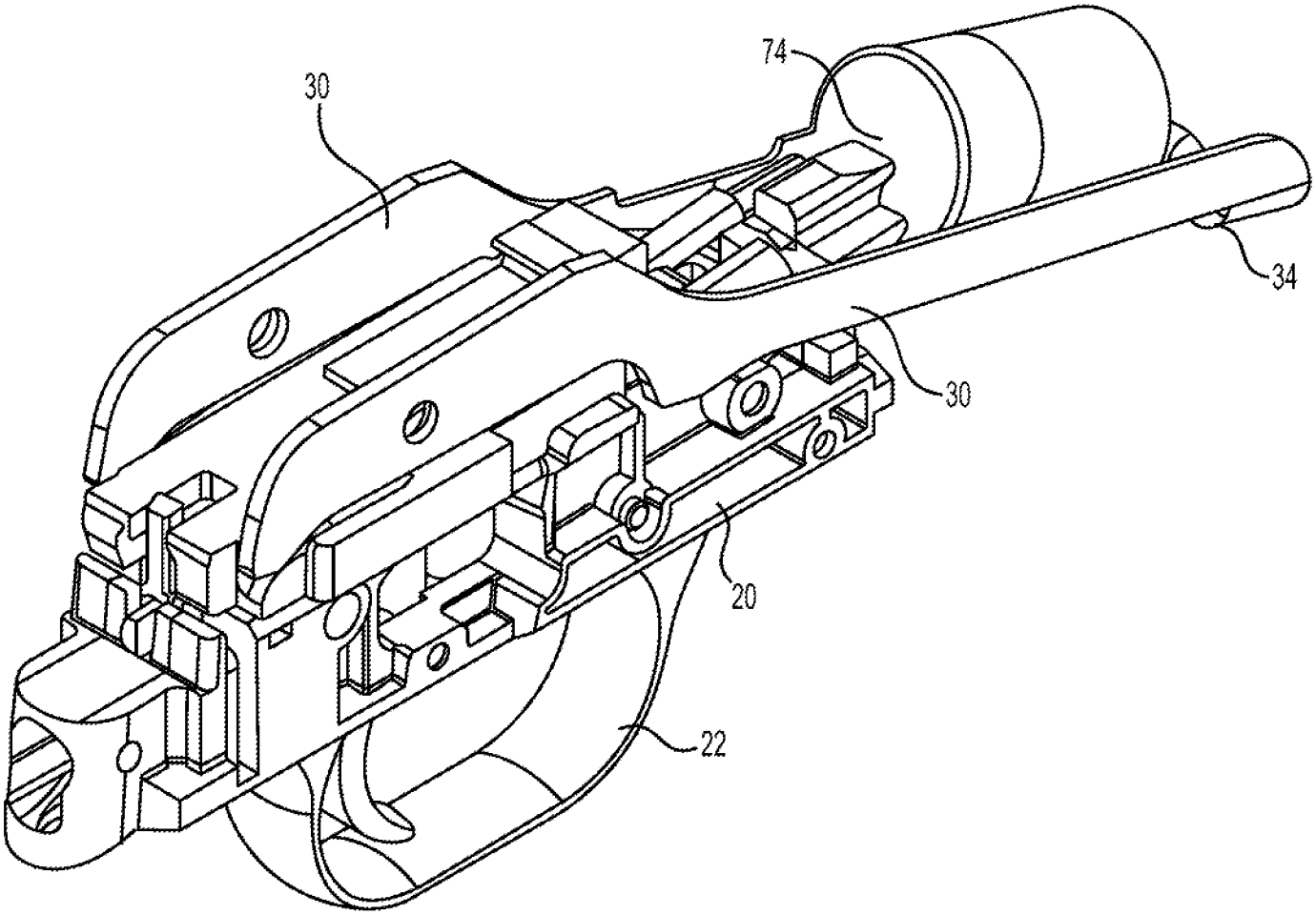
FIG. 4 is a perspective view of a trigger assembly of FIG. 3.
Figure 5:
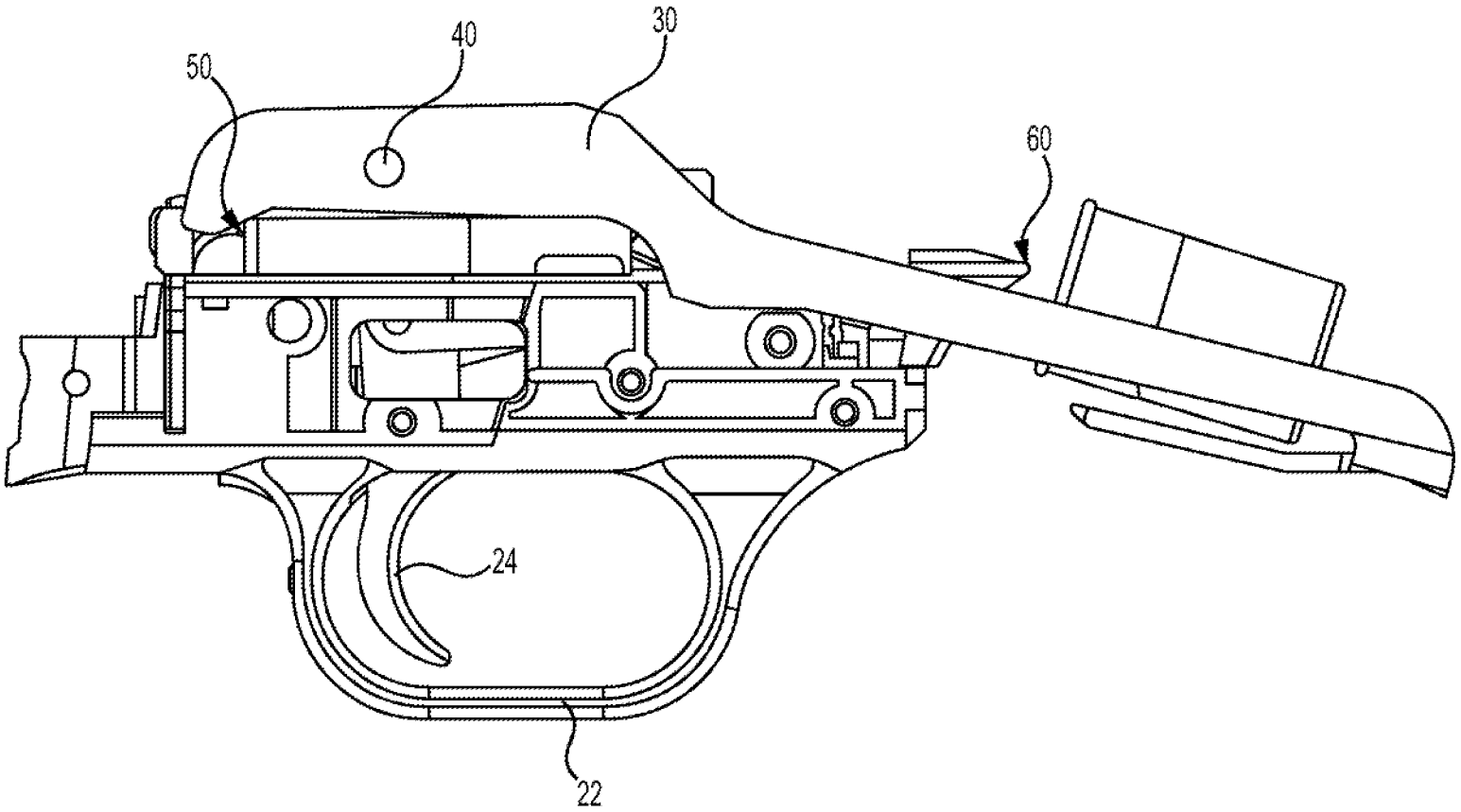
FIG. 5 is a right-side elevation view of the trigger assembly of FIG. 3.

Referring to the Figures, a typical repeating, pump-action firearm design, such as the one shown in FIGS. 1 and 2, is modified to function reliably with shotshells ranging in length from 1¾ to 3 inches. In particular, the drawings depict a modified design version of a firearm, such as or similar to a MOSSBERG 500 or 590 shotgun, that has been modified in accordance with the teachings of the instant invention to reliably cycle shotshells ranging in length from 1¾ to 3 inches. In some embodiments, other firearms are designed from scratch using the disclosed concepts. In some embodiments, the modifications disclosed herein are compatible with other makes and models of firearms, such that the modifications are configured to attached to existing firearms. In some embodiments, firearm 10 includes a receiver 12, grip 13, barrel assembly 14, magazine tube 16, forend 17, and/or trigger assembly 18. In some embodiments, trigger assembly 18 includes housing 20 which is partially received within receiver 12, trigger guard 22, and trigger 24. In some embodiments, housing 20 is configured to receive and retain various fire control components, such as trigger 24 and other fire control components.

Referring to FIGS. 3-7, in some embodiments, shell elevator 28 is disposed within receiver 12. In some embodiments, elevator 28 includes at least one arm, and in some embodiments the elevator includes two arms, 30. It will be appreciated that the modifications to conventional firearm designs included herein are compatible with elevators with a variety of numbers of arms. In some embodiments, elevator 28 includes a shell support 34 extending therebetween the arms 30 from a point proximate to the forward end of elevator 28. In some embodiments, shell support 34 includes a stabilizing pad 36 which in some embodiments extends rearward. In some embodiments, elevator 28 further includes a groove or ramp 38 at or near the front end of elevator 28. In some embodiments, the groove or ramp 38 is configured to direct a shotshell as it moves out of magazine tube 16 and into receiver 12. In some embodiments, each of arms 30 includes a pivot point 40, for receiving a pin or other structure about which elevator 28 pivots. In some embodiments, each of arms 30 includes a forward bearing surface 44, and a rear bearing surface 46 for contacting forward cam surface 48 and rear cam surface 50 on bolt slide 52.

In some embodiments, when the action of the firearm is operated, i.e., by pulling forend 17 towards the rear or otherwise, one or more action bars 54 transmit a force to bolt slide 52. In some embodiments, as bolt slide 52 is moved rearward, bolt assembly 56 moves away from a chamber end of barrel assembly 14 creating a cavity between the breachface 58 of bolt assembly 56 and the chamber end of barrel assembly 14. In some embodiments, forward cam surface 48 initially biases elevator 28 upward through contact with forward bearing surface 44 to support a shotshell being extracted from the chamber. In some embodiments, as bolt slide 52 moves further rearward, forward bearing surface 44 loses contact with forward cam surface 48. In some embodiments, rear cam surface 50 contacts rear bearing surface 46 as the bolt slide 52 moves further rearward, which biases elevator 20 upward at a point to the rear of pivot 40. In some embodiments, this interaction results in to forward portion of elevator 28 dropping downward to receive a shotshell from magazine tube 16. In some embodiments, a shell stop in receiver 12 is disengaged to allow a shotshell to be dispensed from magazine tube 16 and into receiver 12. In some embodiments, when forend 17 is pushed forward, forward cam surface 48 contacts forward bearing surface 44 to bias the forward portion of elevator 28 up.

Still referring to FIGS. 3-7, in some embodiments, when elevator 28 is thus raised, it carries the shotshell dispensed from magazine tube 16 into the cavity between breachface 58 of bolt assembly 56 and the chamber end of barrel assembly 14. In some embodiments, the precise geometry of elevator 28, including front bearing surface 44 and rear bearing surface 46, and that of bolt slide 52, including forward cam surface 48 and rear cam surface 50, dictate the positioning of elevator 28 in relation to breachface 58 during the action cycle. In some embodiments, this configuration is particularly critical to the reliably feeding of shotshells into the chamber of barrel assembly 14. In some embodiments, these geometries have been modified from existing designs to permit the reliable cycling of shotshells ranging in length from 1¾ to 3 inches. In some embodiments, when compared to existing shotguns, shell support 34 and tab 36 extend further to the rear. This increases interaction of elevator 28 with shotshells dispensed from magazine tube 16. In some embodiments, the increased interaction helps stabilize shot shells (or other suitable ammunition) of variable length, especially shorter shot shells, as they are supported for a longer duration of time.

Figure 8:
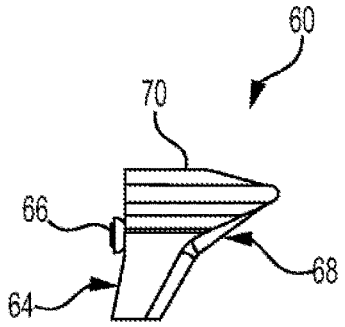
FIG. 8 is a left-side elevation view of a buffer according to some embodiments of the present invention
Figure 9:
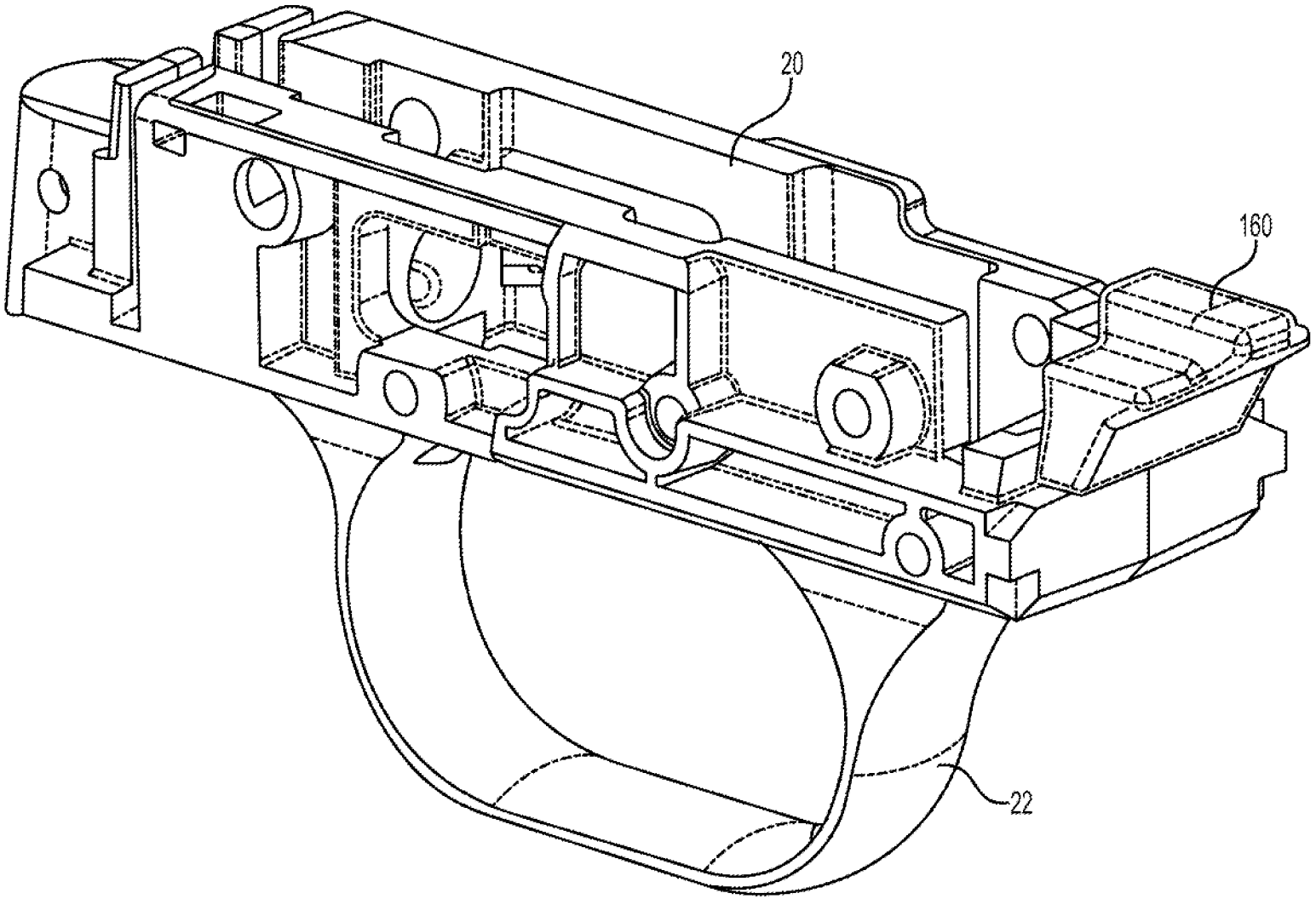
FIG. 9 is a right side elevation view of the trigger assembly of FIG. 3.
Figure 10:
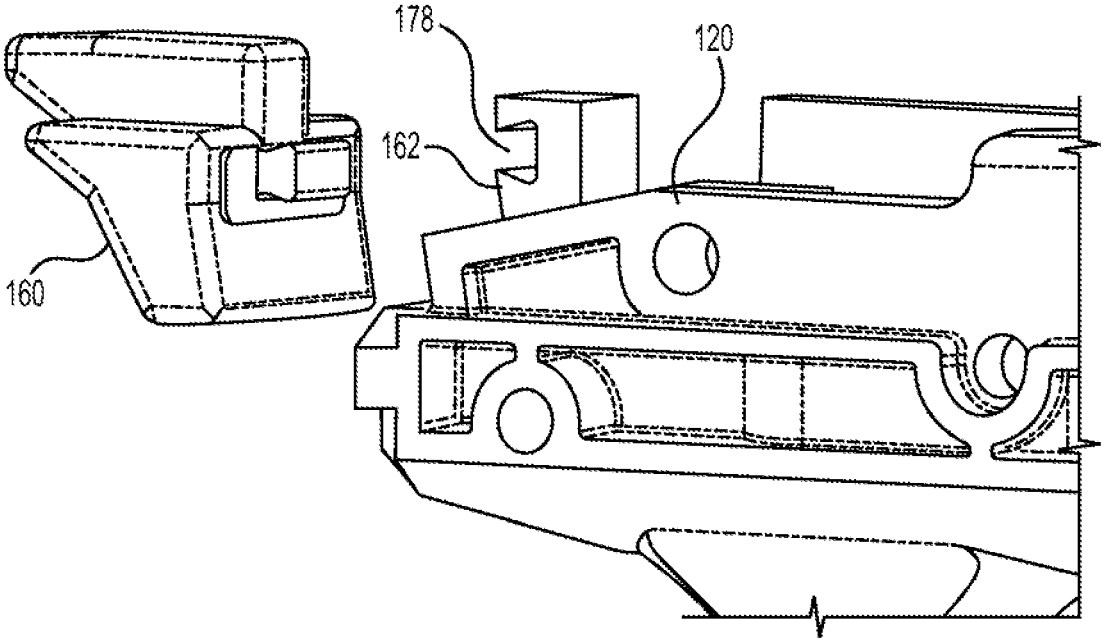
FIG. 10 is a partial perspective view of the trigger assembly of FIG. 3.
Figure 11:
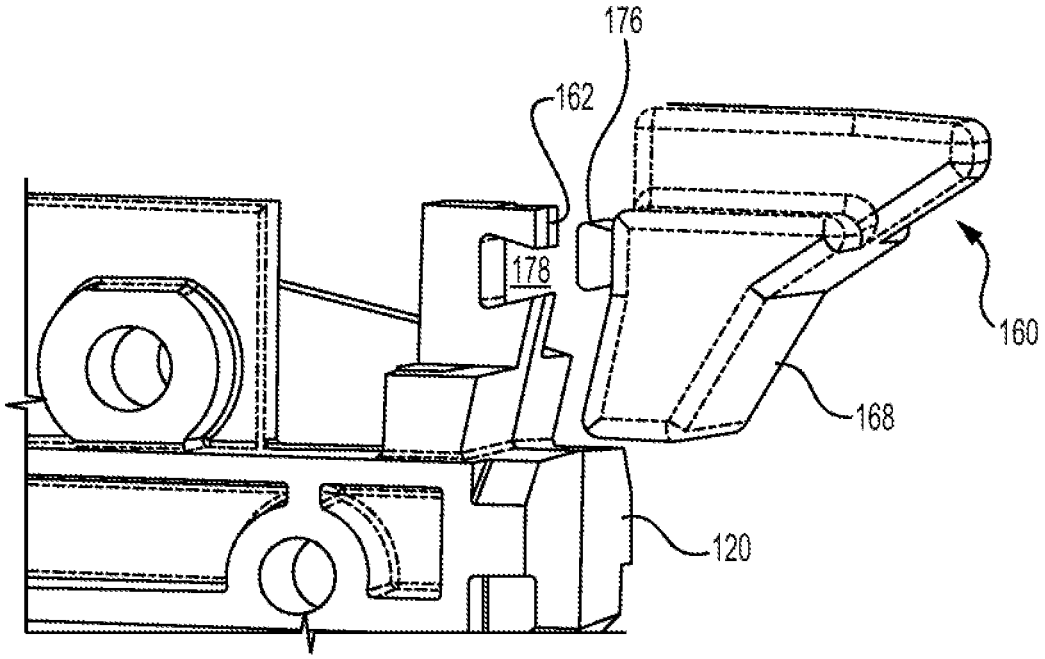
FIG. 11 is a partial perspective view of the trigger assembly of FIG. 3.

Referring to FIG. 8, in some embodiments, firearm 10 further includes buffer 60. In some embodiments, buffer 60 is positioned extending forward of a front face 62 of housing 20 below the course of travel of bolt slide 52 when the action of firearm 10 is cycled. In some embodiments, buffer 60 includes a rear face 64, retention member 66, lower front surface 68, and/or upper surface 70. In some embodiments, rear face 64 is generally configured to contact at least a portion of front face 62 of housing 20, and will in some embodiments further have a curved or angular profile. In some embodiments, retention member 66 extends rearward from rear face 64 and is received within an opening in front face 62 of housing 20. In some embodiments, retention member 66 is cylindrical in shape, has a dovetail cross-section, or other configuration to facilitate coupling buffer 60 to housing 20. In some embodiments, such coupling is achieved by an interference fit between retention member 66 and the opening in front face 62. In some embodiments, buffer 60 is further retained by friction between its sides and inside walls of receiver 12.

In some embodiments, when the action of firearm 10 is cycled, as described above, a shotshell 72 which is shown as a 1¾ inch shotshell but will range in the firearm embodiments shown, from 1¾ to 3 inches, is dispensed from magazine tube 16 and into receiver 12. In some embodiments, shotshell 72 is pushed rearward by a magazine tube follower under spring pressure into opening 73. Shotshell 72 travels rearward until shell base 74 impacts buffer 60 at front face 68. Buffer 60 is configured such that the impact occurs proximate to the mid area of shell base 74 to reduce torque experienced by shotshell 72. In some embodiments the front most tip of buffer 60 contacts above the center of gravity of the shotshell. Shotshell 72 then falls to rest on elevator 28 between arms 30 and along shell support 34 and tab 36. When forend 17 is pushed forward, elevator 28 raises shotshell 70 to a position where bolt assembly 56 can then push shotshell 70 into the chamber of barrel assembly 14.

As a shell enters the receiver from the magazine at a velocity dependent on the mass and payload of the shell, the shell will make contact with the buffer/bumper in front of the trigger housing. The buffer will absorb the impact of the shell, reducing its velocity, depending on the shell's mass and payload, and orientate the shell to suitably engage the elevator. The elevator is ramped upward from the magazine toward the mouth of the chamber by the forward or rearward motion of the action assembly. The vertical orientation of the elevator is controlled by contact with a mating surface on the bolt slide within the action assembly. As the bolt slide is moved forward or rearward, this contact surface ensures that the elevator is in the proper orientation to allow shells of various lengths to either be fed into the chamber of the barrel, or extracted from the chamber and ejected.

Depending on the orientation of the firearm, the length of the shell, and/or the shell's mass and payload, the shell may come in contact with the bumper first, the elevator first, or contact both at the same time. The angle of the faceted face/chines on the buffer/bumper are there to orientate the shell along its longitudinal axis in a direction where the shell is supported by the elevator prior to entering the chamber.

In the embodiment shown, the front-most tip of buffer 60 is located at a point in space within the receiver to be above the center (in some embodiments the physical center, and in some embodiments the center of gravity) of shell and tip the shell downward to prevent improper rotation during they cycling of the shell into the receiver from the magazine. The chines of buffer 60 create a secondary angle to allow for sufficient relief space below the buffer and within the receiver during the loading longer shell into the magazine. The angles of the chines also result in a structure of the buffer that has sufficient mass to absorb the impact of a shell entering the receiver from the magazine, while at the same time minimizing the thickness of the lower portions of the buffer, and minimizing the overall volume of space occupied by the buffer. Proper placement, orientation, and shape of the buffer allow for reliable operation of the firearm in which the buffer is located in a variety of conditions, including, but not necessarily limited to operation from −45 degrees to plus 90 degrees orientations (a 135 degree range of orientation).

Figure 6:
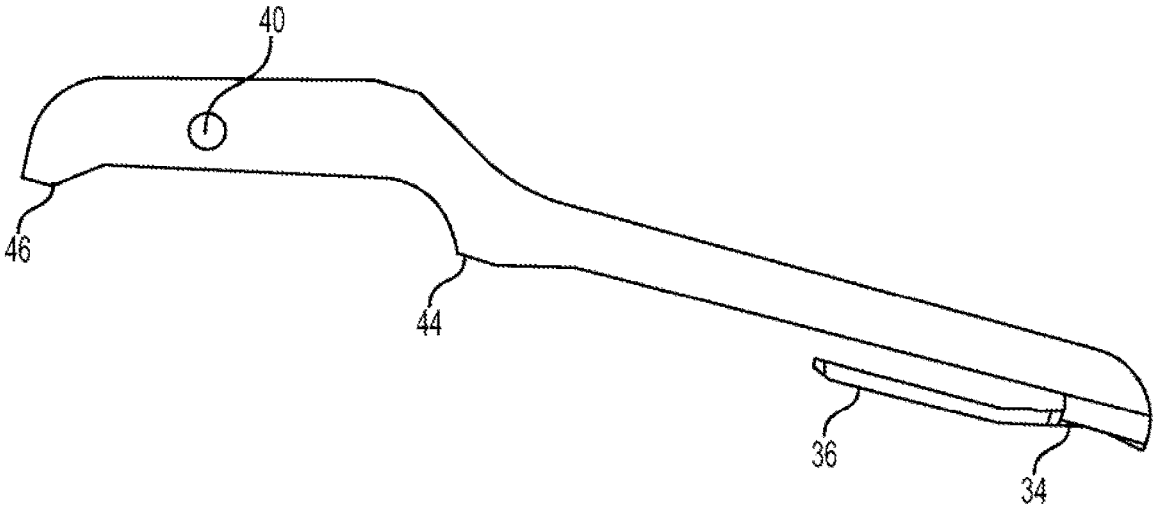
FIG. 6 is a left-side elevation view of an arm according to some embodiments of the present invention.
Figure 7:
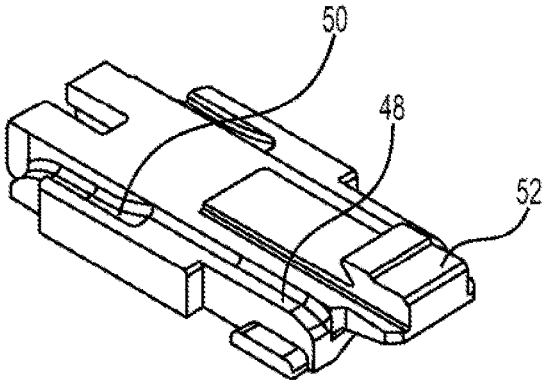
FIG. 7 is a perspective view of a bolt slide according to some embodiments of the present invention.

In some embodiments, stabilizing tab 36 is configured to hold a shotshell towards the rear. In such embodiments, stabilizing tab 36 extends generally upward from support 34 and shaped such that the rim of a shotshell expelled from magazine tube 16 passes over stabilizing tab 36, as seen in FIG. 6. In some embodiments, stabilizing tab 36 is then in front of the rim of the shotshell and hinders its forward movement until pushed back over stabilizing tab 36 by bolt assembly 56.

In some embodiments, buffer 60 is made of a resilient material, such as a polymer including an elastomer, rubber, foam rubber, or other suitable material. In some embodiments, buffer 60 comprises a polyurethane such as a polyether-based polyurethane. The material of buffer 60 is selected to receive the impact of shotshell 72 as it is expelled from magazine tube 16 and act as a shock absorber. This allows buffer 60 to deaden the blow of shotshell 72's impact, reducing the velocity of shotshell 72 and consequently reducing the ability for shotshell 72 to rotate or otherwise contribute to a jamming event. In some embodiments, buffer 60 also occupies a portion of the volume within receiver 12 that is available for shotshell 72 to move within, further reducing the freedom of movement of shotshell 72 and reducing the opportunity for a jamming event.

In some embodiments, the material selected for buffer 60 has a Shore 00 hardness of no more than 100. In some of these embodiments, the material selected for buffer 60 has a shore hardness of no more than 90. In some of these embodiments, the material selected for buffer 60 has a shore hardness of no more than 80. In yet some other of these embodiments, the material selected for buffer 60 has a shore hardness of at least about 50 and no more than about 80. In yet some other of these embodiments, the material selected for buffer 60 has a shore hardness of at least about 60 and no more than about 75.

In some embodiments, buffer 60 configured such that it extends above front face 62 of housing 20. In such embodiments, buffer 60 is configured to be resiliently deformed such that upper surface 70 is compressed rearward and deflected upward. In some embodiments, this configuration allows for shells of greater length, such as 2¾ inch and 3 inch shotshells, to completely exit magazine tube 16.

In some embodiments, upper surface 70 of buffer 60 is sloped or otherwise contoured or angled. In some embodiments, the slope and/or contour are configured to allow the rim around shell base 74 to be unimpeded as shotshell 70 moves forward or rearward in the event shotshell 70 is positioned above buffer 60. This allows for shotshell 70 to move downward to elevator 28 if it winds up positioned above buffer 60.

In some embodiments, with forend 17 in its forward position, bolt assembly 56 is in battery and elevator 28 is in a raised position. In some embodiments, when loaded through the lower opening in receiver 12, the front end of a shotshell is directed towards the opening of magazine tube 16 where it is pushed against either a preceding shotshell or the magazine tube follower. As it is pushed forward by a user, shell base 74 must raise to align shotshell 70 with an axis of magazine tube 16. In some embodiments, buffer 60's lower front face 68 is contoured or angled so as to accommodate shotshells being loaded into magazine tube 16 such that shell base 74 can move upwardly and forward into receiver 12 and then magazine tube 16, such as configured in FIG. 8.

Figure 12:
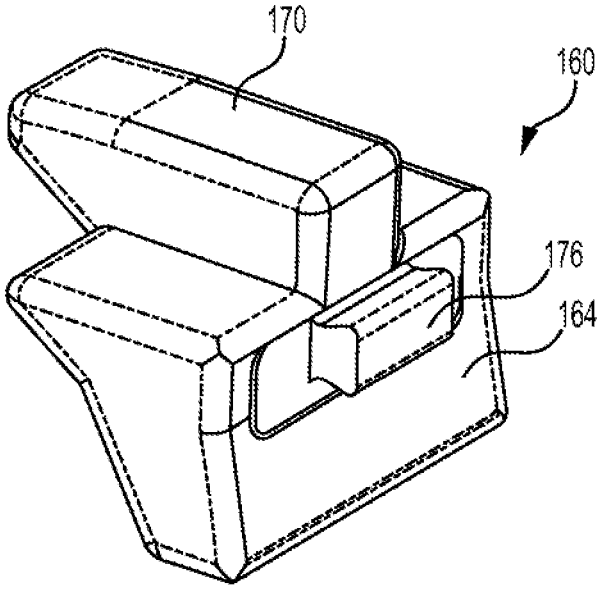
FIG. 12 is a perspective view of an adaptor plate according to some embodiments of the present invention.
Figure 13:
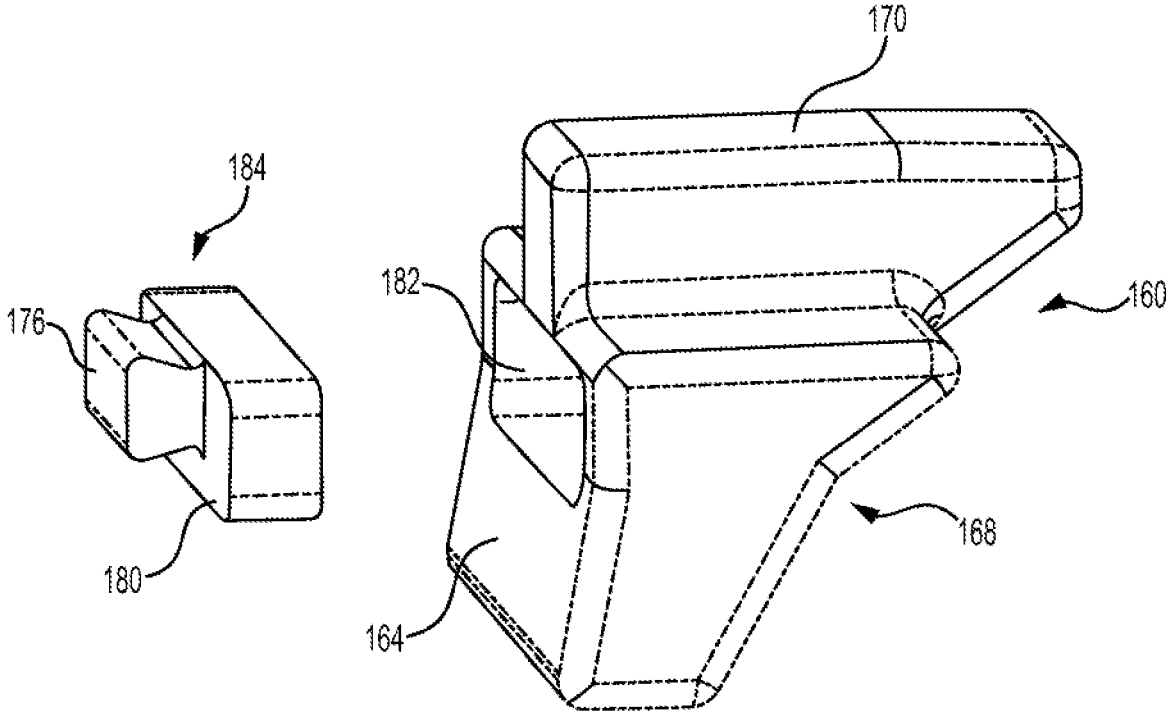
FIG. 13 is a perspective view of a trigger assembly according to some embodiments of the present invention.
Figure 14:
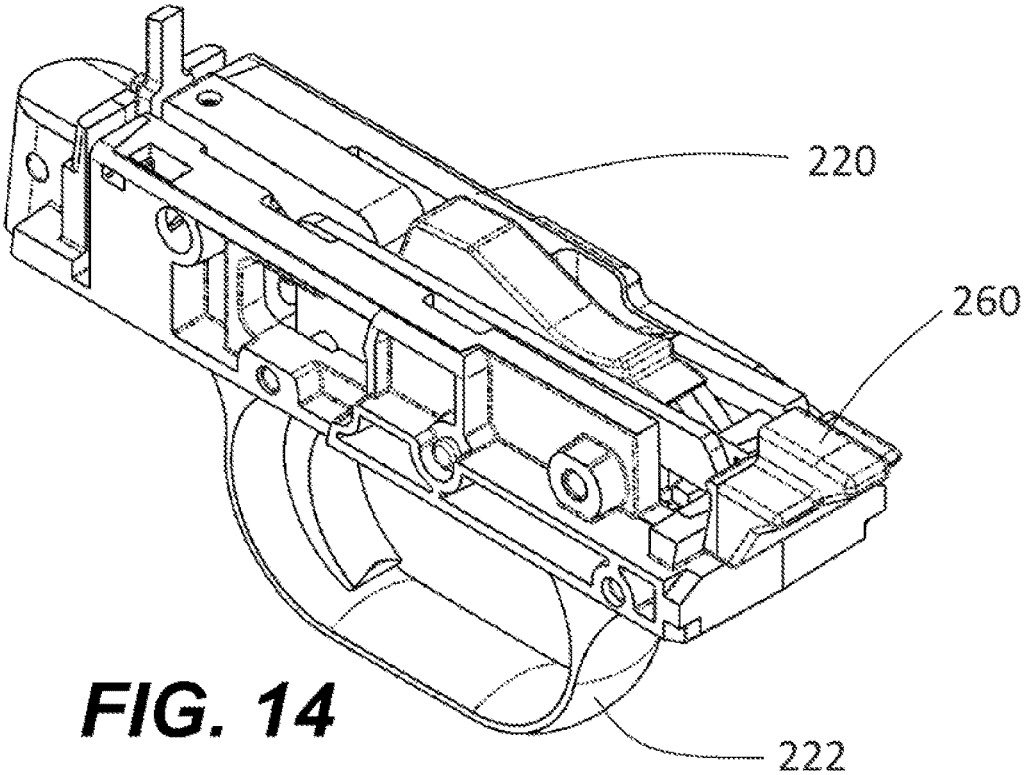
FIG. 14 is a perspective view of a trigger assemble according to some embodiments of the present invention.
Figure 15:
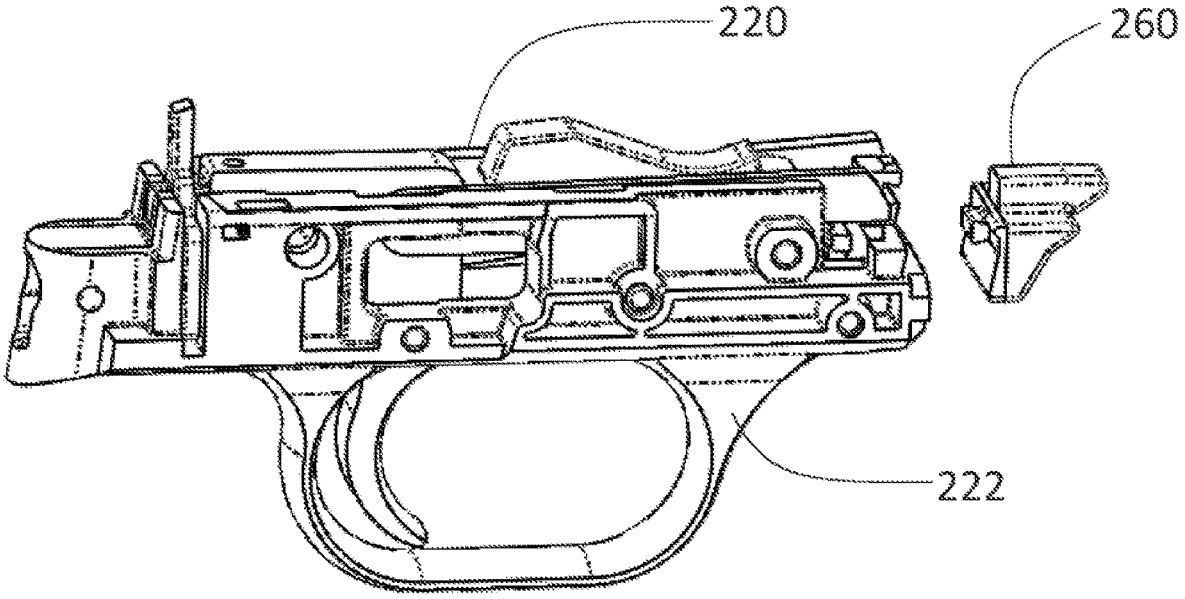
FIG. 15 is a perspective view of the trigger assembly of FIG. 14.
Figure 16:
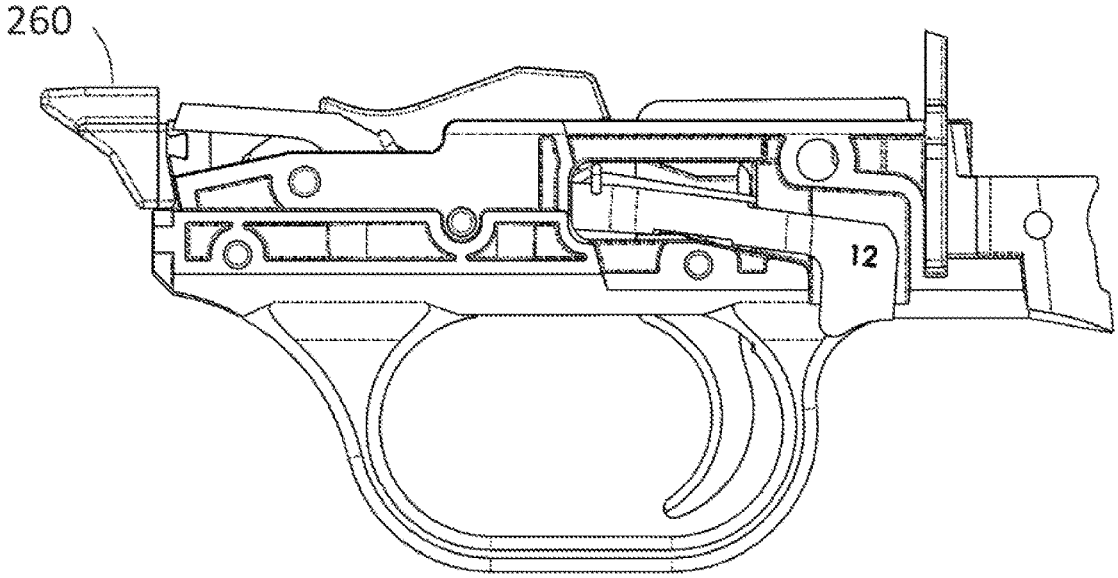
FIG. 16 is a left-side elevation view of the trigger assembly of FIG. 14.
Figure 17:
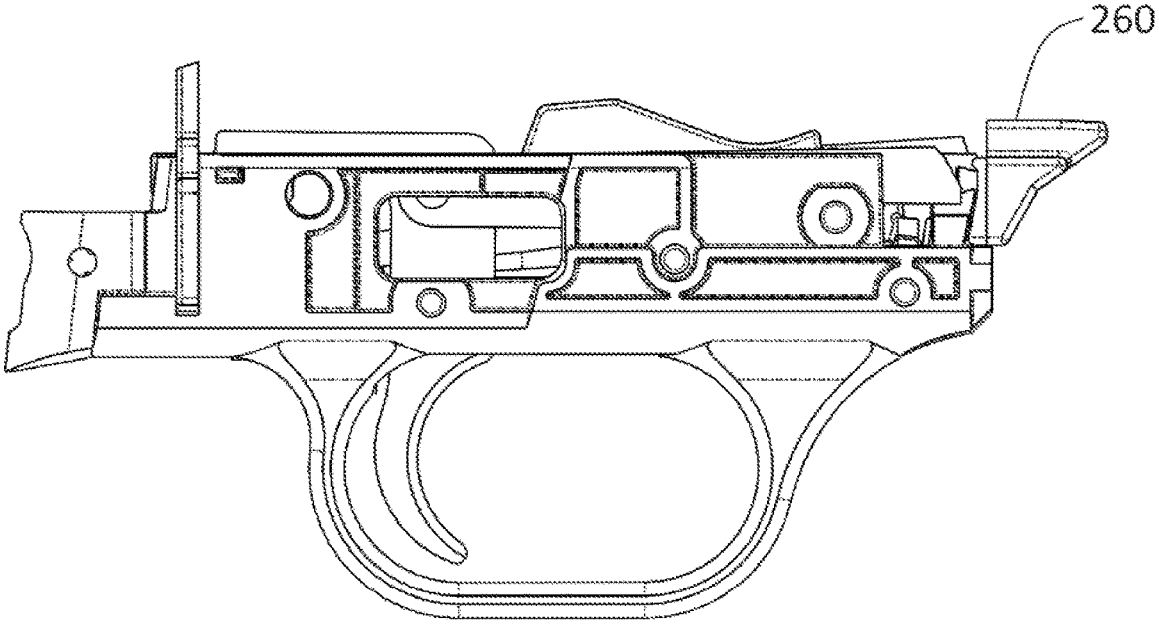
FIG. 17 is a perspective view of a portion of the trigger assembly of FIG. 14.
Figure 18:
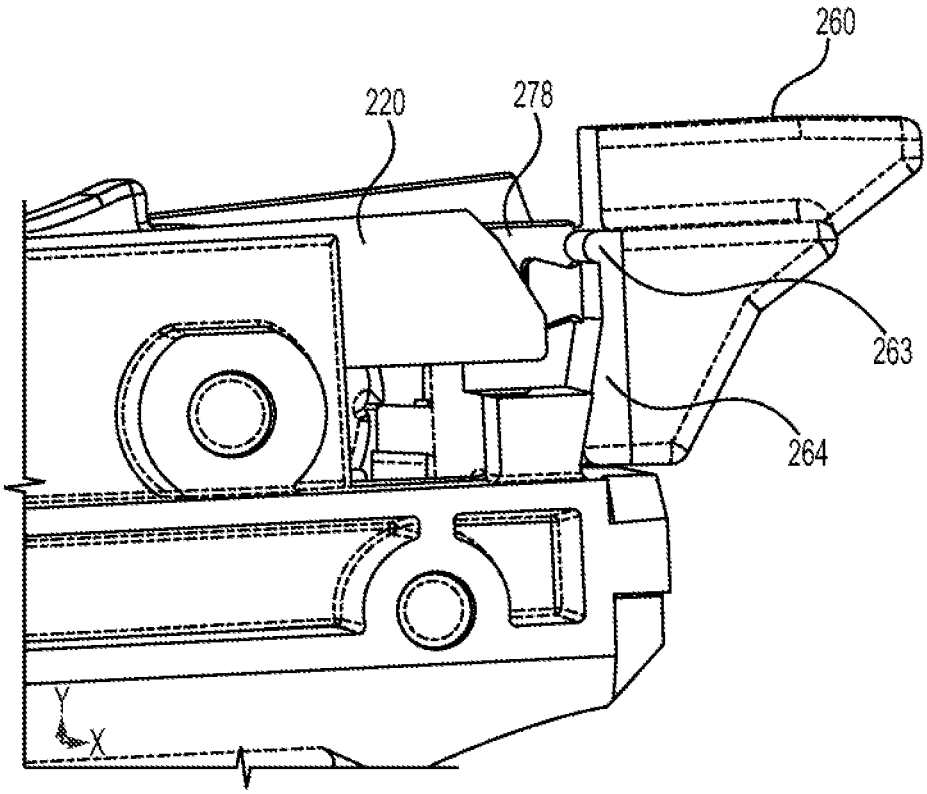
FIG. 18 is a partial perspective view of the trigger assemble of FIG. 14.

Referring to FIGS. 12-13, in some embodiments, the buffer 160 includes a physical connection such as projection 176 which is shown as a dovetail projection. In some embodiments, projection 176 is configured to mate a receptacle 178 shown as a dovetail groove in face 162 of housing 120. In some embodiments, projection 176 extends from base 180 which together form key 184. In some embodiments, buffer 160 includes a receptacle 182 sized to receive at least a portion of base 180. In some embodiments, receptacle 182 is positioned on a rear face 164 of buffer 160. In some embodiments, base 180 is retained in receptacle 182 by an adhesive. In some embodiments, key 184 includes a material of greater hardness and/or rigidity than the rest of buffer 160. In some embodiments, the material has sufficient stiffness to enhance retention of projection 176 in receptacle 178 by providing a resistive force. In some embodiments, the additional stiffness/rigidity of key 184 adds appropriate structure or rigidity to the buffer to provide the desired resulting combination of absorption of energy from and redirection of orientation of a shell entering the receiver from the magazine.

Figure 19:
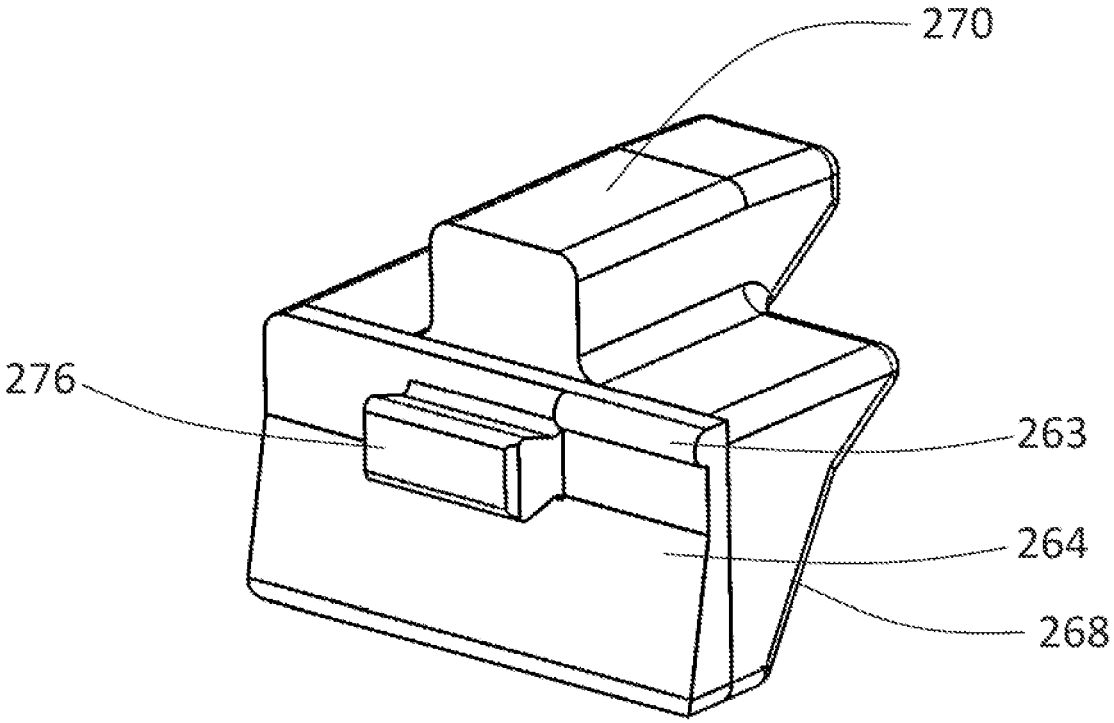
FIG. 19 is a perspective view of an adaptor plate according to some embodiments of the present invention.
Figure 20:
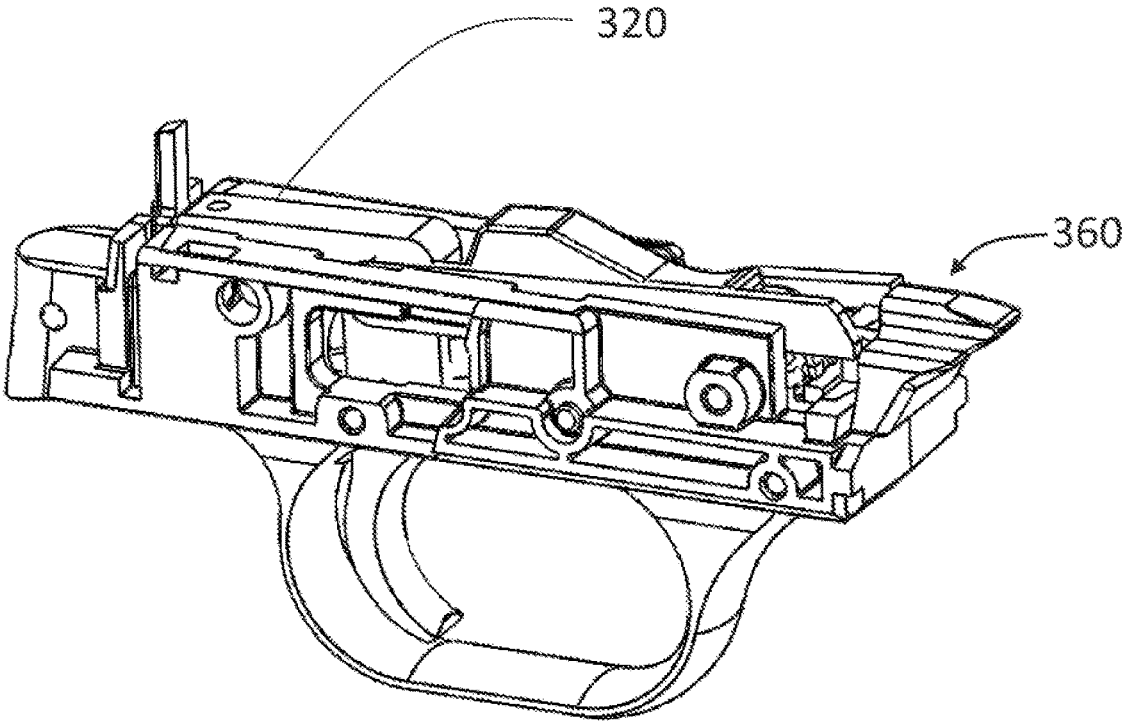
FIG. 20 is a perspective view of a trigger assembly according to some embodiments of the present invention.
Figure 21:
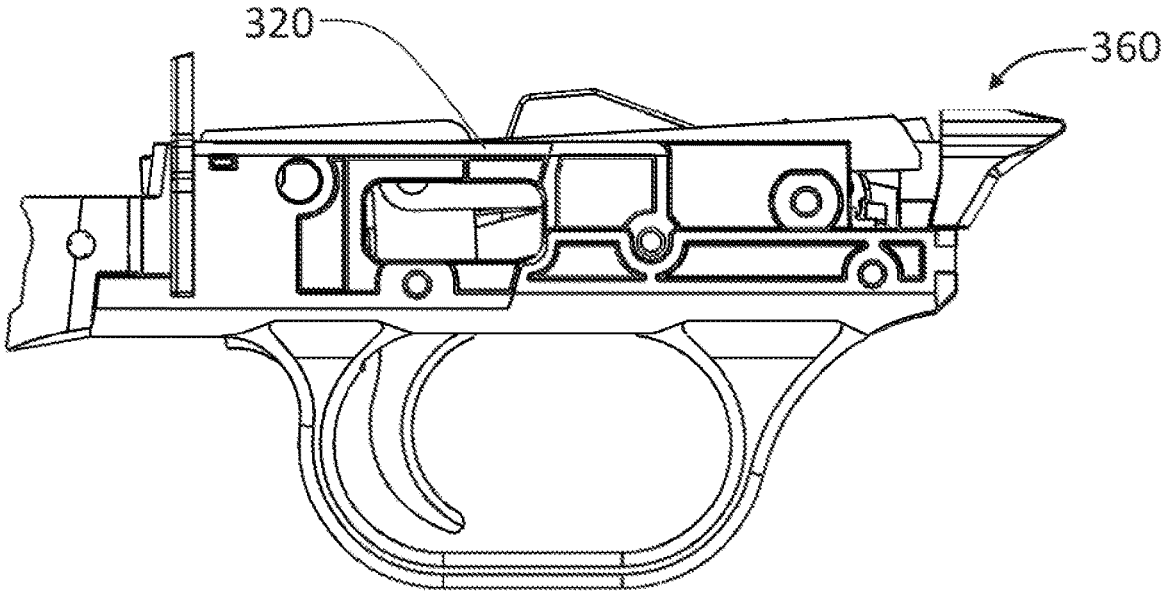
FIG. 21 is a right side elevation view of the trigger assembly of FIG. 20.
Figure 22:
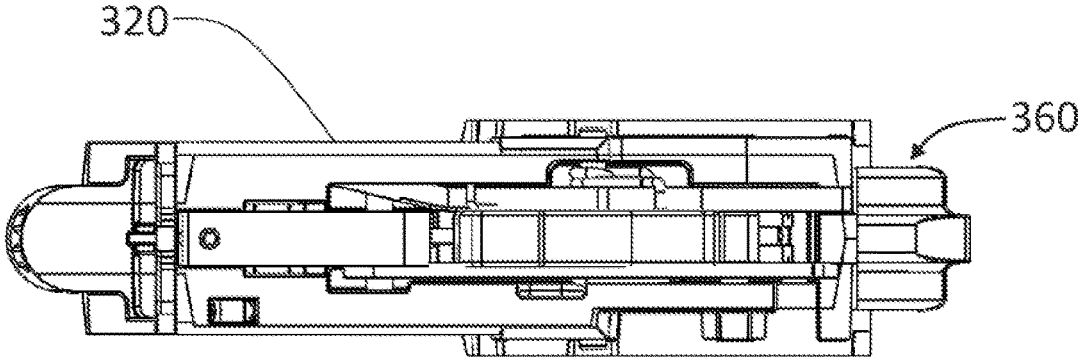
FIG. 22 is a top plan view of the trigger assembly of FIG. 20
Figure 23:
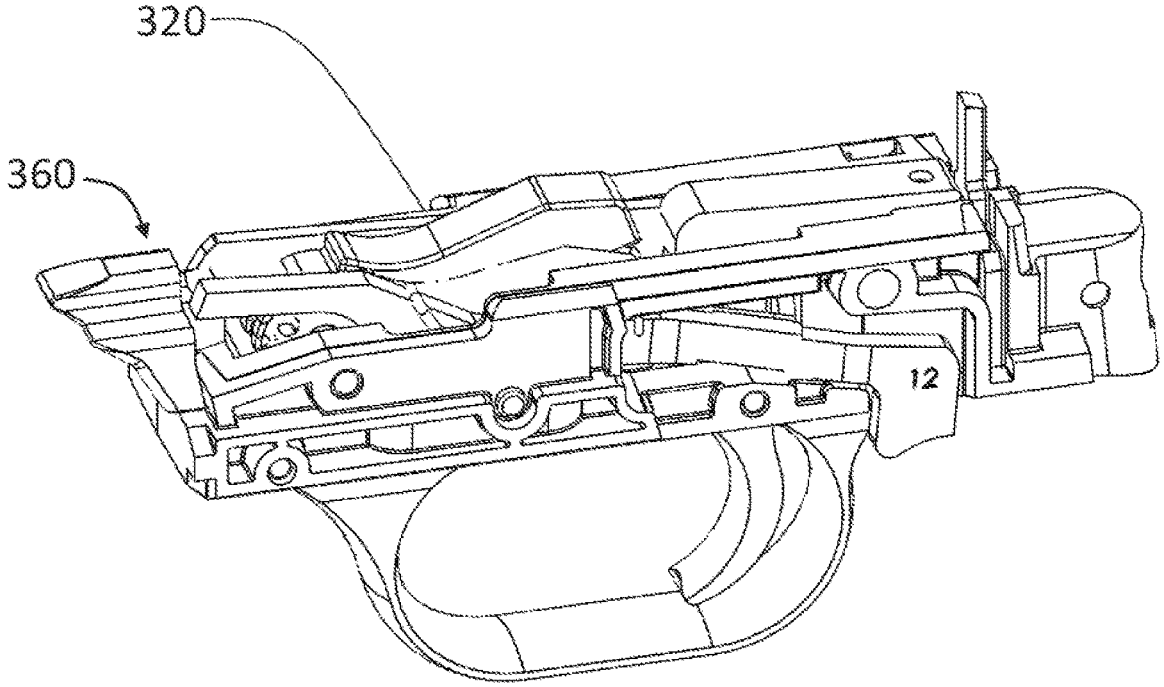
FIG. 23 is a perspective view of the trigger assembly of FIG. 20.
Figure 24:
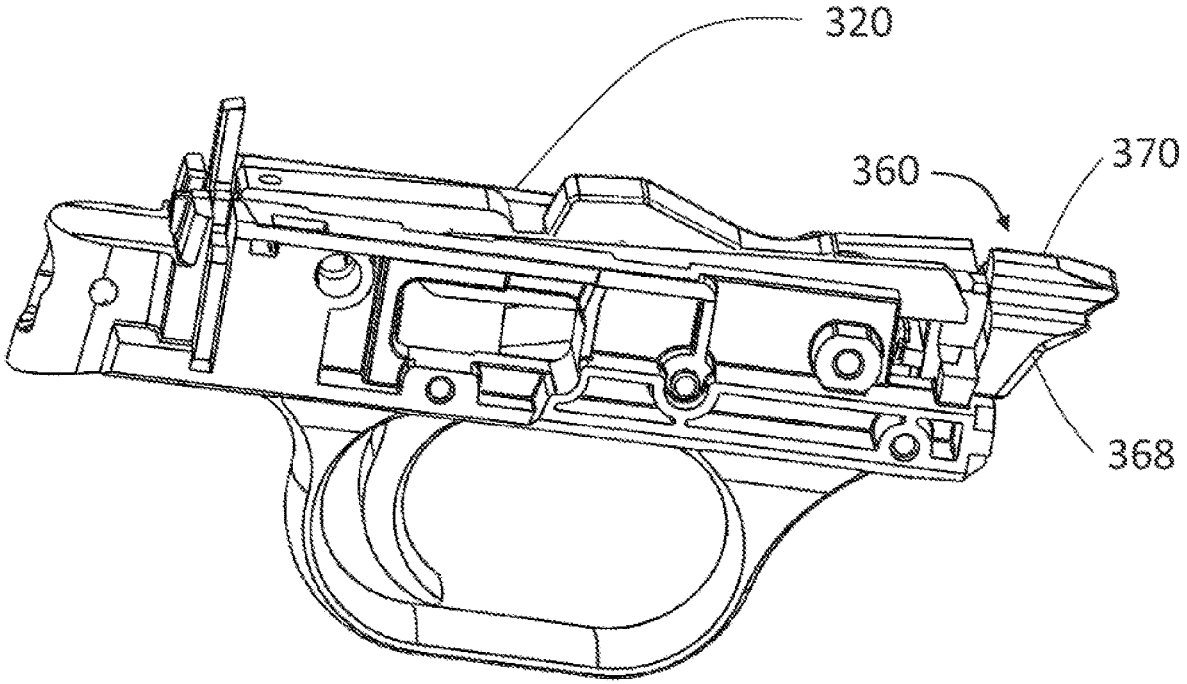
FIG. 24 is a perspective view of the trigger assembly of FIG. 20.

Referring to FIGS. 14-19, In some embodiments, buffer 260 includes one or more insertion feature. In some embodiments, such feature is tab 263. In some embodiments, the tab serves as an over-insertion feature. In some embodiments, projection 276 is configured to mate a receptacle 278 shown as a dovetail groove in a face of housing 220. In some embodiments, projection 276 is configured such as to restrict rotation of the buffer relative to housing 220 with regards to at least one axis of rotation. In some embodiments, such prevention of rotation further stabilizes and restricts an ordnance or shell abutting the buffer. In some embodiments, tab 263 abuts projection 276 along at least one plane, such as being vertically displaced from projection 276 as shown in FIG. 19. In some embodiments, when inserting projection 276 into receptacle 182, tab 263 limits the depth at which insertion can take place. In some embodiments, this prevents a user from over-inserting the buffer 260, adding to ease of use and limiting potential points of failure. Moreover, this limits the buffer 260 during use and resists against vibrational forces from unseating or otherwise displacing buffer 260 from receptacle 182.

In some embodiments, buffer 260 is formed of a single material. In some embodiments, this material is a resilient material, such as polymer including an elastomer, rubber, foam rubber, or other suitable material. In some embodiments, buffer 260 is formed of a plurality of materials. In some embodiments, the materials making up rear face 264, tab 263, projection 276, upper surface 270, and lower front surface 268 are chosen from, but not limited to, a resilient material, such as polymer including an elastomer, rubber, foam rubber, or other suitable material, and a rigid material, such as metal, hardened plastic, or the like. In some embodiments, rear face 264, tab 263, and projection 276 are formed from a rigid material while upper surface 270 and lower front surface 268 are formed from a resilient material. In such embodiments, the rigidity of projection 276, tab 263, and rear face 264 stabilize the buffer 260 in its position relative to receptacle 278 such that when buffer 260 is struck by a shotshell, the buffer remains secure relative to receptacle 278. In some embodiments, the additional stiffness/rigidity of projection 276, tab 263, and rear face 264 adds appropriate structure or rigidity to the buffer to provide the desired resulting combination of absorption of energy from and redirection of orientation of a shell entering the receiver from the magazine. Upper surface 270 and lower front surface 268, being made of a resilient material, are still configured to deform resiliently when struck with a shotshell such as to act as a stabilizer, reducing the likelihood of a jamming event.

In some embodiments, rear face 264 makes up at least part of a mounting plate. In some embodiments, the mounting plate further includes tab 263 and/or projection 276. In some embodiments, the mounting plate is configured to interface with a rear face of housing 220. In some embodiments, the interface is achieved through mating of the housing with the rear face through one or more connection means, such as receptacle 278. In some embodiments, the mounting plate is made of a rigid material, while the rest of buffer 260 is made of a resilient material. In some embodiments, the additional stiffness/rigidity of the mounting plate adds appropriate structure or rigidity to the buffer to provide the desired resulting combination of absorption of energy from and redirection of orientation of a shell entering the receiver from the magazine. The rest of buffer 260, including upper surface 270 and lower front surface 268, being made of a resilient material, is still configured to deform resiliently when struck with a shotshell such as to act as a stabilizer, reducing the likelihood of a jamming event.

Referring to FIGS. 20-24, in some embodiments, buffer 360 is connected to housing 320. In some embodiments, buffer 360 is connected via an adhesive means, such as glue, epoxy, tack, spray adhesive, polyurethane, or the like. In some embodiments, the adhesive is of sufficient strength to secure buffer 360 to housing 320 during normal operation of the firearm. In some embodiments, buffer 360 is formed onto housing 320, such that the forming process of buffer 360 adheres buffer 360 to housing 320. In yet some other embodiments, buffer 360 is integrated within housing 320, such that housing 320 and buffer 360 are at partly formed of a single continuous material. In some embodiments, the adhesion is permanent, while in other embodiments buffer 360 is configured to selectively couple to housing 320 through an adhesive means. In some embodiments, upper surface 370 and lower front surface 368 are formed of a resilient material. When buffer 360 is struck by a shotshell, upper surface 370 and lower front surface 368, being made of a resilient material, are configured to deform resiliently while the adhesive secures the buffer to the housing, preventing the buffer from translating and/or rotating relative to the housing 320. In some embodiments, due to the resilient material and secure adhesion of buffer 360 to housing 320, buffer 360 acts as a stabilizer, reducing the likelihood of a jamming event.

Although the buffer of the inventive concept is shown herein in embodiments in which the buffer is attached to or formed as part of the trigger housing, it will be appreciated that in other embodiments, the buffer is not directly attached to the trigger housing. In some embodiments, the buffer is attached to an intermediate component (or components) that is attached to the trigger housing. In other embodiments, the buffer is attached to other components within the receiver. In some such embodiments, the buffer is attached to one or more wall of the receiver.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall within the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A firearm comprising:

a receiver;

a barrel coupled to and extending forward of the receiver;

a magazine tube coupled to and extending forward of the receiver;

a trigger housing positioned at least partially within the receiver, the trigger housing including a front face with a receptacle; and a buffer located within the receiver, wherein the buffer comprises an insertion feature configured to couple with said front face receptacle, and wherein said insertion feature prevents the buffer from rotating relative to said trigger housing.

2. The firearm of claim 1, wherein the buffer is configured to selectively couple and decouple from the front face receptacle of the trigger housing.

3. The firearm of claim 2, wherein the buffer further comprises a tab, the tab configured to limit a horizontal depth of insertion when coupling the buffer to the trigger housing by contacting the housing during insertion, thereby preventing the insertion feature from being over-inserted into said front face receptacle.

4. The firearm of claim 3, wherein the buffer extends above the front face of the trigger housing when the buffer is coupled to the trigger housing.

5. The firearm of claim 4, wherein the buffer comprises an upper surface, the upper surface including a sloped portion, the sloped portion configured to allow the rim around a base of a shot shell associated with the firearm to be unimpeded as the shot shell moves forward or rearward.

6. The firearm of claim 5, wherein the buffer is configured to enable the reliable cycling of shot shells ranging in length from 1.75 inches to at least 3 inches, the buffer contacting the shot shell proximate to a mid area of the base of the shot shell regardless of the length of the shell.

7. The firearm of claim 1 further comprising an elevator having a center support tab configured to support a shell ranging in length from 1.75 inches to 3 inches.

8. The firearm of claim 1 further comprising a bolt slide having at least one cam surface configured to control a vertical movement of an elevator in relation to a horizontal movement of the bolt slide.

9. The firearm of claim 1 wherein the buffer extends from a front face of the trigger housing towards an opening in the receiver in which the magazine tube is partially received.

10. A buffer for a firearm, the buffer comprising:

a main body with a front face, a rear face, and an upper surface positioned therebetween; and a projection attached to the rear face, wherein the projection is configured to couple with a receptacle associated with a front face of a trigger housing of a firearm, and wherein the projection prevents the buffer from rotating relative to said trigger housing when the buffer is coupled with the receptacle associated with a front face of said trigger housing.

11. The buffer of claim 10, wherein the projection is dovetail shaped and the receptacle is a dovetail groove.

12. The buffer of claim 10, further comprising an insertion feature proximate the projection on the rear face.

13. The buffer of claim 12, wherein the insertion feature is configured to limits a horizontal depth of insertion when coupling with a receptacle of the trigger housing by contacting the front face during insertion, thereby preventing the projection from being over-inserted into said front face receptacle.

14. The buffer of claim 10, wherein the front face is contoured to allow for a round of ammunition to be loaded into a magazine of a firearm when the buffer is interfacing with coupled to a receptacle associate with a housing of the firearm.

15. The buffer of claim 10, wherein the buffer comprises a flexible material having a Shore 00 hardness of no more than about 100.

16. The buffer of claim 15, wherein the front face is contoured to impact a round of ammunition in a mid-area of a base of said round when the buffer is interfaced with a firearm and wherein said contact is in a consistent location when the shot shell is 1.75 inches in length and when the shot shell is 3 inches in length.

17. The buffer of claim 16, wherein the contouring of the front face allow for said round of ammunition to be loaded into a magazine the firearm when the buffer is interfaced with the firearm.

18. A method of modifying a firearm, the method comprising the steps:

locating a receptacle on a front face of a trigger housing of a firearm;

inserting a buffer into said receptacle, wherein the buffer is inserted horizontally into a receptacle of the trigger housing by way of a projection, wherein the buffer comprises an insertion feature, wherein the projection prevents the buffer from rotating relative to said housing when the buffer is interfacing with the receptacle associated with said housing, and wherein an upper surface of the buffer extends relatively higher than an upper surface of the front face of the trigger housing.

19. The method of claim 18, wherein the buffer comprises a flexible material having a Shore 00 hardness of no more than about 100.

* * * * *